US008042364B2

(12) United States Patent
Cao et al.

(10) Patent No.: US 8,042,364 B2
(45) Date of Patent: Oct. 25, 2011

(54) WASHING MACHINE WITH IMPROVED WATERWAY SYSTEM

(75) Inventors: Chunhua Cao, Qingdao (CN); Peishi Lv, Qingdao (CN); Sheng Xu, Qingdao (CN); Song Gai, Qingdao (CN); Yuling Chen, Qingdao (CN); Zeheng Li, Qingdao (CN)

(73) Assignees: Haier Group Corporation, Qingdao (CN); Qingdao Haier Washing Machine Co., Ltd., Qingdao (CN)

( * ) Notice: Subject to any disclaimer, the term of this patent is extended or adjusted under 35 U.S.C. 154(b) by 547 days.

(21) Appl. No.: 12/191,822

(22) Filed: Aug. 14, 2008

(65) Prior Publication Data

US 2009/0266115 A1 Oct. 29, 2009

(30) Foreign Application Priority Data

Apr. 29, 2008 (CN) ..... 2008 1 0094396

(51) Int. Cl.
*D06F 39/02* (2006.01)
*D06F 35/00* (2006.01)

(52) U.S. Cl. ..... 68/13 R; 68/13 A

(58) Field of Classification Search ..... 68/13 A, 68/13 R, 23.5
See application file for complete search history.

(56) References Cited

U.S. PATENT DOCUMENTS

| | | | | |
|---|---|---|---|---|
| 3,073,674 | A * | 1/1963 | Rudelick | 423/112 |
| 3,227,382 | A * | 1/1966 | Frederick | 242/432.6 |
| 4,434,629 | A * | 3/1984 | Bianchi et al. | 68/13 A |
| 6,132,572 | A | 10/2000 | Kim | |
| 6,461,446 | B1 | 10/2002 | Satoh et al. | |
| 6,689,276 | B2 * | 2/2004 | Caruthers, Jr. | 210/687 |
| 2006/0117596 | A1 * | 6/2006 | Kim et al. | 34/607 |

FOREIGN PATENT DOCUMENTS

| | | | |
|---|---|---|---|
| CN | 1255880 | C | 5/2006 |
| CN | 1310255 | C | 4/2007 |
| DE | 36 40 881 | A1 | 6/1988 |
| JP | 2000-014986 | A | 1/2000 |
| JP | 2000-027263 | A | 1/2000 |
| JP | 2002-524256 | A | 8/2002 |
| JP | 2003-024680 | A | 1/2003 |
| JP | 2003-079560 | A | 3/2003 |
| JP | 2003-220296 | A | 8/2003 |

* cited by examiner

*Primary Examiner* — Joseph L. Perrin
(74) *Attorney, Agent, or Firm* — Buchanan Ingersoll & Rooney PC

(57) ABSTRACT

The present invention has disclosed a washing machine with improved waterway system, said waterway system is comprising softening-electrolysis waterway, modifier-liquid waterway and ion-exchange-resin regeneration waterway, when this washing machine is at work, modifier-liquid combined with alkaline-electrolysis water could replace detergent for washing; meantime, said ion-exchange-resin regeneration waterway could greatly prolong the service life of softening-electrolysis system, and avoid the refluence of wastewater to cause pollution in the washing machine in prior art.

20 Claims, 4 Drawing Sheets

WASHING MACHINE WITH IMPROVED WATERWAY SYSTEM

TECHNICAL FIELD OF THE INVENTION

The present invention is about a kind of washing machine with improved waterway system. In further, this invention is concerning the washing machine with improved waterways with softening-electrolysis waterway and regenerated-resin waterway.

BACKGROUND OF THE INVENTION

The prior washing machines make use of water combined with scour which usually brings heavy pollution to clean clothes, thus someone provided the method of using strongly basic electrolysis water along with modifier liquid in the washing proccess to reduce the pollution, several references concerning the above method are as follow:

The patent reference of JP2003220296 has disclosed a washing apparatus, e.g. drum-type washing machine, has partition wall made of non-conductive material, arranged in electrolysis tank, forming segmented chambers which have respective electrodes.

Another patent reference of JP2003024680 has disclosed a washing machine e.g. drum-type washing machine, consists of electrolyzer which includes lower and upper water flow paths connected to electrolytic cell and wash tub respectively.

The third patent reference of JP2003079560 has disclosed a dishwasher for use in home, has electrolyzer which produces electrolyzed water to perform washing and bleaching, after completion of dish washing operation.

The fourth patent reference of JP2002524256T has disclosed a water producing apparatus for deodorization and cleaning applications comprises an electrolyzer and two end plates arranged at both ends of the electrolyzer.

The fifth patent reference of JP2000027263 has disclosed a sanitary washing machine for sterilizing toilet fixture—has electrolyte storage unit, electrolysis unit carrying electrolyte and electrode pair and discharge unit for discharging treated water.

The sixth patent reference of JP2000014986 has disclosed a water supply system of washing machine—uses metal ion desorption device with capture and release units to capture metal ions and release into tap water supplied into washing tub from tap water feed mouth.

But as the hard water somewhere, long-time frequent use may shorten the service life of electrolyzer, thus the technical scheme to electrolyze softened water is provided to improve the softness of clothes, the typical scheme is published as below:

The patent reference of CN99800057 has disclosed washing items are washed, simultaneously washing water comprising alkali metal ion and at least one of carbonate ion and bicarbonate ion is softened. The washing water before being softened is obtained by electrolysing an aqueous solution of sodium hydrogen carbonate having a pH of 9.5 or more and an electric conductivity of 150 mS/m or more. The softened washing water has a total hardness of 40 ppm or less.

It's to say that the washing method of this patent of CN99800057 has the technical feature: washing water comprising alkali metal ion and at least one of carbonate ion and bicarbonate ion is softened in one hand, and the washing items are washed simultaneously in the other hand.

Thus the above washing water in the washing chamber is softened using the following method: washing items and washing water with alkali metal ion and at least one of carbonate ion and bicarbonate ion are together bought into the washing chamber to bond the calcium ion or magnesium ion with the carbonate ion or bicarbonate ion and separate out the calcium carbonate and calcium bicarbonate to soften the washing water.

Apparently, the technical scheme disclosed in this patent is to make use of the electrolysis water as the washing water, meantime adding corresponding materials to finish the softening process. Additionally, the metal ions in the softener play the assistant role in the washing process.

The patent reference of CN00110127 has disclosed an electrochemical washing machine including a barrel and a water container respectively acting also as carriers of two electrodes, an electrochemical mechanism and an electric controller. It has the advantages of making the washing process, which includes the steps of softening water, emulsifying and decomposing oil dirt, rinse and disinfection, softening clothing and sizing, saving in time and cost by means of electrophoresis and electrolysis. The especially electrochemical detergent has low cost, less consumption and less environmental pollution.

The patent reference of DE3640881 has disclosed a water softening system—with integral electrochemical cell producing the regenerating electrolyte, especially involving an ion exchanger of a water softening installation is regenerated by using an electrolyte. The electrolyte is produced by an electrochemical reaction in the working water of the water softening installation itself instead of adding an electrolyte. Pref. The water supply to the water softening unit has a T-piece leading to a valve and a line to the washing medium container. A three-way valve can be opened towards line so that soft water can be passed through the washing medium in through line to the washing machine or dishwasher. After the electrochemical cell in the unit has been activated, the water, enriched with hardness causing salts, can be discharged via valve to the lines.—USE/ADVANTAGE—This saves the necessity of having to dispose of water enriched with the substance which causes the hardness. The regeneration is fully automatic. For washing machines and dishwashers.

The service lives of the softening device with complicated structure used in the technical scheme of the above patent references aren't long enough, but going against the large scale industrial production.

The present invention is provided under the above background.

SUMMARY OF THE INVENTION

The purpose of the present invention is to provide a washing machine with an improved waterway system.

The above purpose is realized as following technical scheme:

A washing machine with improved waterway system, said washing machine is comprising of the outer drum, inner drum, water-inlet system, water-outlet system and driving device along with controller, wherein, said water-inlet system is composed of softening-electrolysis waterway including softening device, electrolyzer and several sets of pipes; said water-inlet system is also composed of modifier-liquid measured waterway including metering valve, modifier-liquid supplier and several sets of pipes; said water-inlet system is further composed of ion-exchange-resin regeneration waterway including regenerated-brine device and several sets of pipes.

The inlet of said water-inlet system is mounted with four-pass water-inlet valve, one end of which is connecting to tap water inlet, the other end is set four controlled outlets connecting to each end of four pipes respectively, wherein, one of said four pipes is connecting to said modifier-liquid measured waterway, another one is connecting to influent groove, the third one is connecting to said softened electrolysis waterway, the last one is connecting to said ion-exchange-resin regeneration waterway.

Said modifier-liquid measured waterway is comprising metering valve, modifier-liquid supplier and several sets of pipes, the metering valve is connecting to the modifier-liquid supplier by pipe, the inlet of metering valve is connecting to said four-pass water-inlet valve by pipe, two outlet of metering valve are respectively connecting to influent groove and said water-outlet system by pipes.

Said softening-electrolysis waterway is comprising softening device, electrolyzer and several sets of pipes, the water-inlet pipe of softening device is connecting to four-pass water-inlet valve, the softened-water outlet of softening device is connecting to electrolyzer, the wastewater outlet is connecting to said water-outlet system by pipe, alkaline-electrolysis water outlet of electrolyzer is connecting to influent groove by pipe, acid-electrolysis water outlet is connecting to said water-outlet system by siphon.

Said ion-exchange-resin regeneration waterway comprises regenerated-brine device and several sets of pipes, the water inlet of regenerated-brine device is connecting to the four-pass water-inlet valve by pipe, the regenerated-brine outlet is connecting to the regenerated-brine inlet of softening device, the overflow port is connecting to said water-outlet system.

Said metering valve consists of inlet valve used for controlling the connection status of influent groove, modifier-liquid valve used for controlling the connection status of modifier-liquid supplier with metering valve and drain valve used for controlling the connection to said water-outlet system, air valve is set on the top of modifier-liquid supplier to control the air circulation.

Resin-storage chamber is set inside the softening device, inside the resin-storage chamber resin is held by bracket, said softened-water outlet and regenerated-brine inlet are set on the top of the softening device, close to the regenerated-brine inlet there set a floating ball used to shut down the regenerated-brine inlet, check valve is set at the waste-water outlet which is set on the lower part of the softening device, water-inlet pipe is set at the bottom of the softening device or the side close to the bottom.

Said regenerated-brine device comprises case, salt-storage through located in the upper space and brine-dissolved chamber formed by the remaining space of the regenerated-brine device, the water inlet and overflow port are respectively set on the two sides, the vertical height of above water inlet is higher than above overflow port, regenerated-brine outlet is set on the bottom of the case, at least one permeable hole is located around the salt-storage through, filter screen covers on said permeable hole.

When said softening-electrolysis waterway is at work, water from said four-pass water-inlet valve gets into the softening device by pipe and gets touch with the ion-exchange-resin, rising water level to lift the floating ball to close regenerated-brine inlet, softened water goes through the softened-water outlet and is electrolyzed inside the electrolyzer; acid-electrolysis water is drained to the water-outlet system by siphon, alkaline-electrolysis water reaches the influent groove by alkaline-electrolysis water outlet, further gets into the inner drum of washing machine.

Check valve is mounted at the wastewater outlet of softening device, alkaline-electrolysis water outlet and wastewater outlet of the electrolyzer is of pressure, when the drainage function of the acid-electrolysis water is of no effect, the acid-electrolysis water would be prevent from getting into the softening device and electrolyzer.

With combination of alkaline-electrolysis water, modifier-liquid measured waterway is provided in this present invention, modifier-liquid could be sent to the influent groove by the modifier-liquid measured waterway after being measured.

Said modifier-liquid measured waterway consists of metering valve, this metering valve is composed of inlet valve, modifier-liquid valve and drain valve, the working scheme is as follow: open inlet valve firstly, then water from the four-pass water-inlet valve would clean the valve chamber of metering valve, wastewater is drained from drain valve; further open air valve and modifier-liquid valve, modifier-liquid from the modifier-liquid supplier to metering valve is measured by this valve, close said air valve and modifier-liquid valve, stop providing modifier-liquid, open inlet valve again to rush the measured modifier-liquid into the influent groove by pipe. Said modifier-liquid combined with alkaline-electrolysis water form good condition for washing.

Constant quantity and concentration brine in the said ion-exchange-resin regeneration waterway provided by the present invention to meet the requirement of regeneration of ion-exchange-resin to satisfy the effect of softening, it could achieve that ion-exchange-resin could be regenerated by opening brine valve to send regenerated-brine into softening device.

When said ion-exchange-resin regeneration waterway is at work, water from the four-pass water-inlet valve would be sent from regenerated-brine inlet to brine-dissolved chamber by pipe, said brine-dissolved chamber is the lower space under the salt-storage through inside the case, overflow port is set on the side with lower vertical location than water inlet set on the other side, redundant water would be drained from the overflow port, water in brine-dissolved chamber gets touch with the salt through the mesh of the filter screen covering on the permeable holes which set on the bottom and side of salt-storage through in a predetermined period to form brine with predetermined concentration, then said brine with predetermined concentration would reach softening device by regenerated-brine outlet and regenerated-brine inlet after opening brine valve The floating ball wouldn't shut down the regenerated-brine inlet because of the low water level when water from regenerated-brine device gets immersing ion-exchange-resin, thus ion-exchange-resin is immersed in brine and regenerated, after the ion-exchange-resin is regenerated in a predetermined period, drain wastewater from the wastewater outlet.

Upper outfall is set in the water-outlet system, the bottom of the regenerated-brine device isn't lower than the height of upper outfall.

The elbow position of siphon and/or the location of overflow port of regenerated-brine device are/is higher the water level inside inner drum.

To avoid inverted siphon caused by the broken of pipes, a check valve is mounted on the pipe between four-pass water-inlet valve and softening device, and/or on the pipe between four-pass water-inlet valve and metering valve, thus avoid the pollution of tap water caused by the inverted siphon of mixture of modifier-liquid and water.

Electromagnetic valve is assembled between electrolyzer and softened-water outlet, after the ion-exchange-resin is regenerated, open water inlet to drain wastewater from wastewater outlet by pressure, close the electromagnetic valve to hold back wastewater from the electrolyzer.

Drainage vessel set on the pipe between the overflow port and water-outlet system is connecting to the pipe between the wastewater outlet of softening device and water-outlet system.

A better softening electrolysis system used in the washing machine is provided in the present invention in the above technical scheme; this system would greatly improve the service life of softening device with simple structure and is suitable for large scale industrial production.

The further specification of embodiment according to the drawings is as follow.

Figure 1:
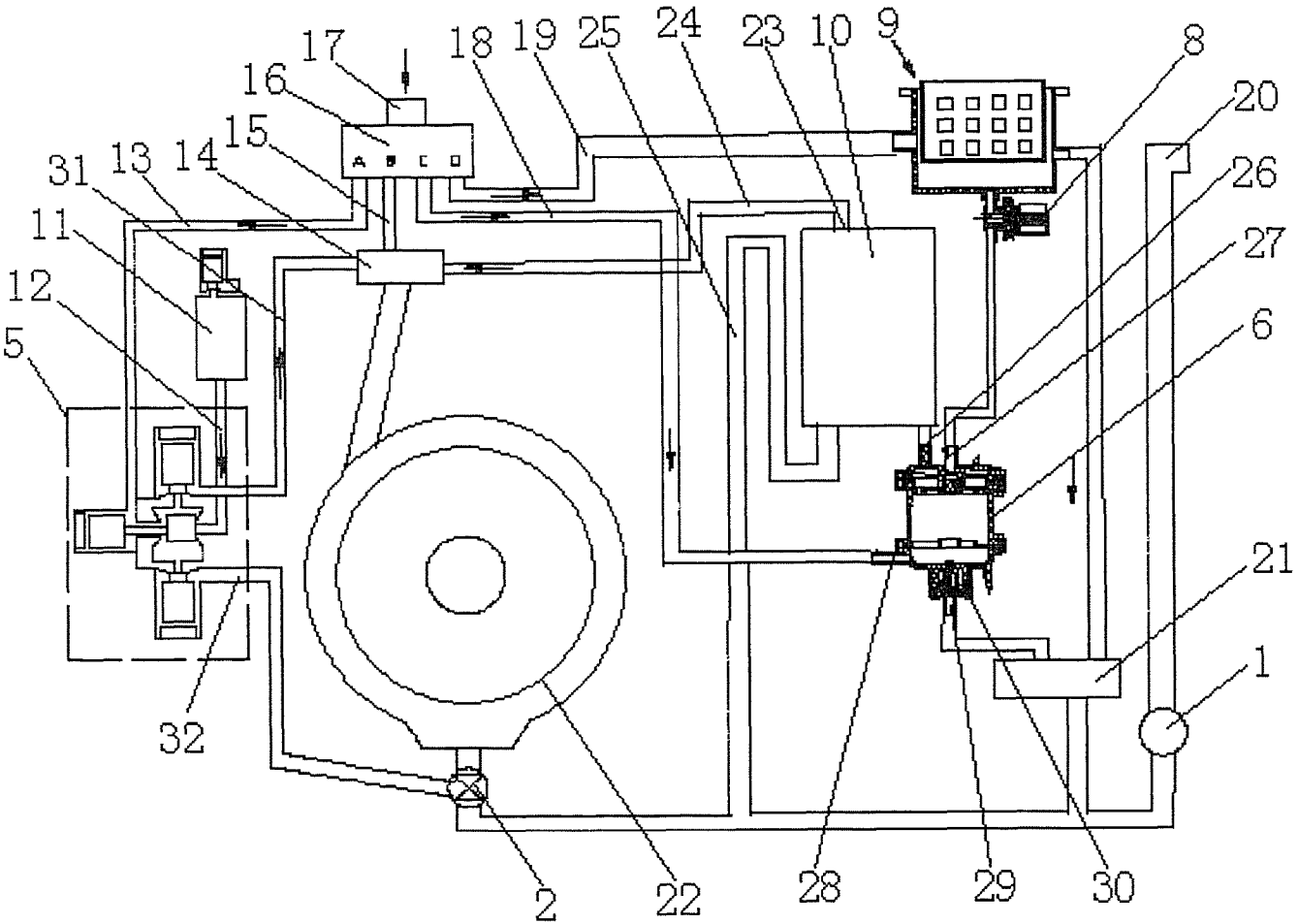
FIG. 1 is the schematic view of improved waterway system of washing machine provided in the present invention.

To clearly show the technical scheme of the present invention, the following content is the specification of the names of devices and their relating mark.

drainage pump 1, drain valve 2, filter screen 3, permeable hole 4, metering valve 5, softening device 6, bracket 7, brine valve 8, regenerated-brine device 9, electrolyzer 10, modifier-liquid supplier 11, pipe 12, pipe 13, influent groove 14, pipe 15, four-pass water-inlet valve 16, tap water inlet 17, pipe 18, pipe 19, upper outfall 20, drainage vessel 21, washing machine 22, alkaline-electrolysis water outlet 23, pipe 24, acid-electrolysis water siphon 25, softened-water outlet 26, regenerated-brine inlet 27, water-inlet pipe 28, pipe 29, check valve 30, pipe 31, pipe 32, air valve 33, valve core 34, inlet valve 35, modifier-liquid valve 36, drain valve 37, salt-storage through 38, overflow port 39, regenerated-brine outlet 40, brine-dissolved chamber 41, water inlet 42 case 43, floating ball 44, resin-storage chamber 45, wastewater outlet 46, spring 47.

DESCRIPTION OF THE PREFERRED EMBODIMENTS

As shown in FIG. 1-4, the present invention provide a washing machine with a improved waterway system, said washing machine comprises outer drum, inner drum, water-inlet system, water-outlet system and driving device as well as controller, said water-inlet system is comprising softening-electrolysis waterway including softening device 6, electrolyzer 10 and several sets of pipes; said water-inlet system is also comprising modifier-liquid measured waterway including metering valve 5, modifier-liquid supplier 11 and several sets of pipes; said water-inlet system is further comprising ion-exchange-resin regeneration waterway including regenerated-brine device 9 and several sets of pipes.

Said modifier-liquid measured waterway is comprising metering valve 5 modifier-liquid supplier 11 and several sets of pipes 12,13,31,32, metering valve 5 is connecting to the modifier-liquid supplier 11 by pipe 12, the inlet of metering valve 5 is connecting to said pipe 13, two outlets of metering valve 5 are respectively connecting to the influent groove 14 by pipe 31 and said water-outlet system by pipe 32. Said metering valve 5 consists of inlet valve 35 used for controlling the connection status of pipe 31 and influent groove 14, modifier-liquid valve 36 used for controlling the connection of modifier liquid supplier 11 and metering valve 5 by pipe 12 and drain valve 37 used for controlling the connection of pipe 32 and water-outlet system, air valve 33 is set on the top of modifier-liquid supplier 11 for the air circulation.

Said softening-electrolysis waterway is comprising softening device 6, electrolyzer 10 and several sets of pipes 18,24, 25,28,29, water-inlet pipe 28 of softening device 6 is connecting to pipe 18, softened-water outlet 26 of softening device 6 is connecting to electrolyzer 10, wastewater outlet 46 is connecting to said water-outlet system by pipe 29, alkaline-electrolysis water outlet 23 of electrolyzer 10 is connecting to influent groove 14, acid-electrolysis water outlet of electrolyzer 10 is connecting to said water-outlet system by siphon 25. Resin-storage chamber 45 is set inside softening device 6, inside the resin-storage chamber 45 resin is held by bracket 7, said softened-water outlet 26 and regenerated-brine inlet 27 are set on the top of the softening device 6, inside the resin-storage chamber 45 close to the regenerated-brine inlet 27 there set a floating ball 44 used to shut down the regenerated-brine inlet 27, check valve is set close to the waste-water outlet 46 which is set on the lower part of the softening device 6, water-inlet pipe 28 is set at the bottom or the side close to the bottom of softening device 6.

Said ion-exchange-resin regeneration waterway comprises regenerated-brine device 9 and several sets of pipes, the water inlet 42 of regenerated-brine device 9 is connecting to pipe 19, regenerated-brine outlet 40 is connecting to the regenerated-brine inlet 27 of softening device 6 by pipe, overflow port 39 is connecting to said water-outlet system. Said regenerated-brine device 9 comprises case 43, salt-storage through 38 located in the upper part and brine-dissolved chamber 41 formed by the remaining space of the regenerated-brine device 9, the water inlet 42 and overflow port 39 are respectively set on two sides of case 43, the vertical height of water inlet 42 is higher than overflow port 39, regenerated-brine outlet 40 is set on the bottom of the case 43, at least one permeable hole 4 is located around the salt-storage through 38, filter screen 3 is covering on the said permeable hole 4.

The using method of the waterway system of the washing machine provided by the present invention is as follow:

As shown in FIG. 1, four-pass water-inlet valve 16 is assembled at the water inlet of the water-inlet system, one end of four-pass water-inlet valve 16 is connecting to tap water inlet 17, the other end is set four controlled outlets connecting to each end of four pipes 13,15,18,19 respectively.

The other end of pipe 13 is connecting to metering valve 5.

The other end of pipe 15 is connecting to influent groove 14.

The other end of pipe 18 is connecting to softening device 6.

The other end of pipe 19 is connecting to regenerated-brine device 9.

Wherein drain pipe 32 of metering valve 5 is connecting to drainage pump 1 by drain valve 2. Acid-electrolysis water siphon 25 and drainage vessel 21 are respectively connecting to drainage pump 1 in order to open the drainage pump 1 to drain wastewater by the upper outfall 20 if necessary.

If users want to make use of the detergent or scour, it will pre-store constant detergent inside the detergent chamber in the influent groove 14, water from the port 16A of four-pass water-inlet valve gets into influent groove 14 by pipe 13 and inlet valve 35 to rush said detergent or scour into the inner drum, meanwhile measured water is repeatedly provided to inner drum to finish the washing process of the whole washing, rinsing and dehydration according to the program.

If some user wants to make use of alkaline-electrolysis water combined with modifier-liquid instead of said detergent or scour, the program would be turned into another pre-proceeding to operate.

At the beginning of washing process, the controller of the washing machine would judge the quality of the tap water used.

After water passing softening device 6, the exchange of ion in the resin is reduced if the water quality is good enough, it is no need to take the replacement of ion-exchange-resin; otherwise, it's necessary to take the placement process. Water should be softened by softening device 6 before it goes into electrolyzer 10, it will effectively prolong the service life of the electorlyzer 10.

Figure 4:
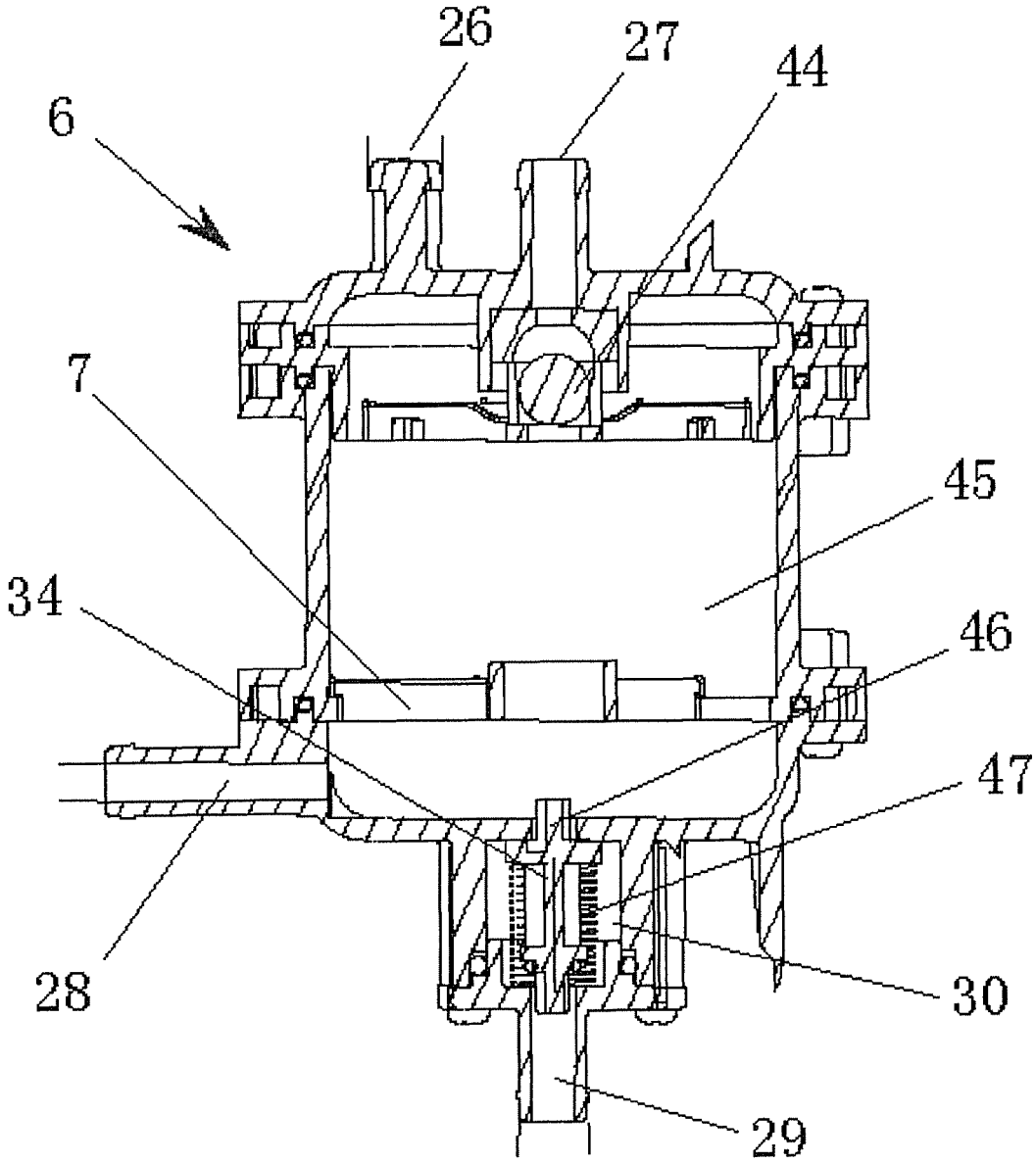
FIG. 4 is the partial detailed schematic view of the improved waterway system close to softening device.

The working principle of softening device 6 is as follow, as shown in FIG. 1 and FIG. 4, resin-storage chamber 45 is set inside the softening device 6, to soften water, water from four-pass water-inlet valve 16 would goes into the space under bracket 7 by water-inlet pipe 28, as the water level is gradually rising, water through the holes on the bracket 7 would get in touch with resin held by bracket 7 and be softened, when the water lifts floating ball 44 to plug regenerated-brine inlet 27, softening water would go into electrolyzer 10 by softened-water outlet 26, but never go into regenerated-brine device 9 by regenerated-brine inlet 27.

As shown in FIG. 1, softened water from softening device 6 is electrolyzed inside electrolyzer 10, said electrolyzer 10 is dissepiment electrolyzer, and alkaline-electrolysis water and acid-electrolysis water would be formed at the two sides of dissepiment.

Acid-electrolysis water would be drained by siphon after the accumulation of acid-electrolysis water reaches a level.

After the accumulation of alkaline-electrolysis water reaches a level, alkaline-electrolysis water would goes into the fluent groove 14 by alkaline-electrolysis water outlet 23 and pipe 24, and then reaches the inner drum of washing machine 22.

Figure 2:
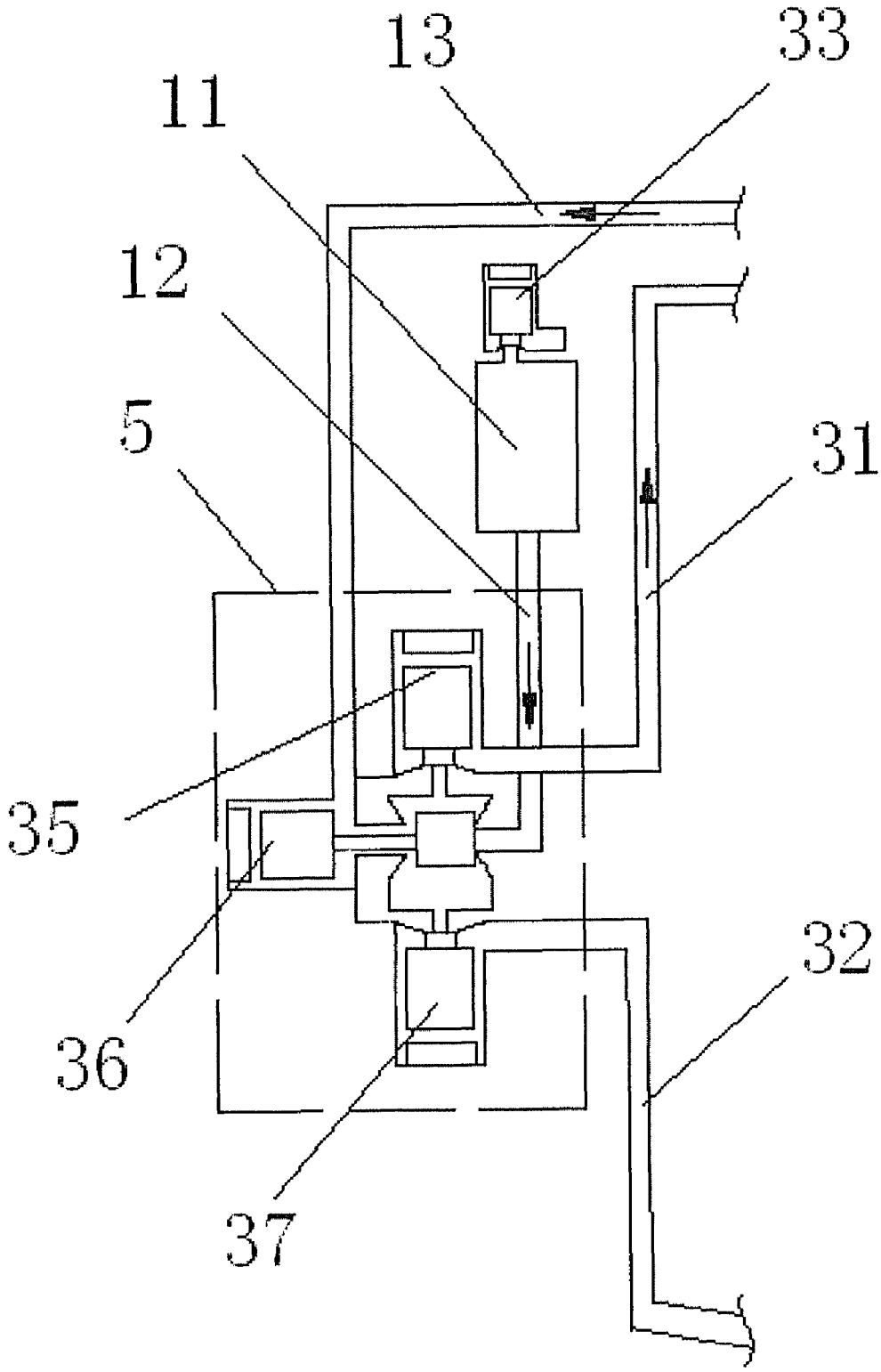
FIG. 2 is the partial detailed schematic view of the improved waterway system close to metering valve.

As shown in FIG. 2, effect of lower wash would be caused by only using alkaline-electrolysis water, thus modifier-liquid supplier 11 is set in the improved waterway provided in the present invention, wherein modifier-liquid would be added into washing machine by metering valve 5 to improve the washing effect.

The process of measuring modifier-liquid is as follow:

Metering valve 5 is made up of inlet valve 35, modifier-liquid valve 36 and drain valve 37, they are connecting to pipe 13,31,32,12 respectively, the other end of pipe 12 is connecting to the outlet of modifier-liquid supplier 11, the vertical position of said modifier-liquid supplier 11 is higher than metering valve 5, air valve 33 is set on the top of the modifier-liquid supplier 11. To avoid inverted siphon caused by the broken of pipes, check valve is set on pipe 13, water from four-pass water-inlet valve 16 goes into metering valve 5 by check valve, meanwhile mixture of modifier-liquid and water in the metering valve 5 can't draw back to tap water without pollution.

When using the metering valve 5, open inlet valve 35 firstly, then water from the four-pass water-inlet valve 16 goes into and cleans the valve chamber of metering valve by pipe 13, wastewater is drained from drain valve 37; further open air valve 33 and modifier-liquid valve 36, modifier-liquid from the modifier-liquid supplier 11 to metering valve 5 is measured by the valve, close said air valve 33 and modifier-liquid valve 36, stop providing modifier-liquid, open inlet valve 35 again to rush the measured modifier-liquid into the influent groove 14 by pipe 31. Said modifier-liquid combined with alkaline-electrolysis water and washing water can clean clothes in washing machine.

Generally, after a term of working, the resin in softening device 6 would be of no effect, and would be needed to regenerate by brine with constant concentration.

Figure 3:
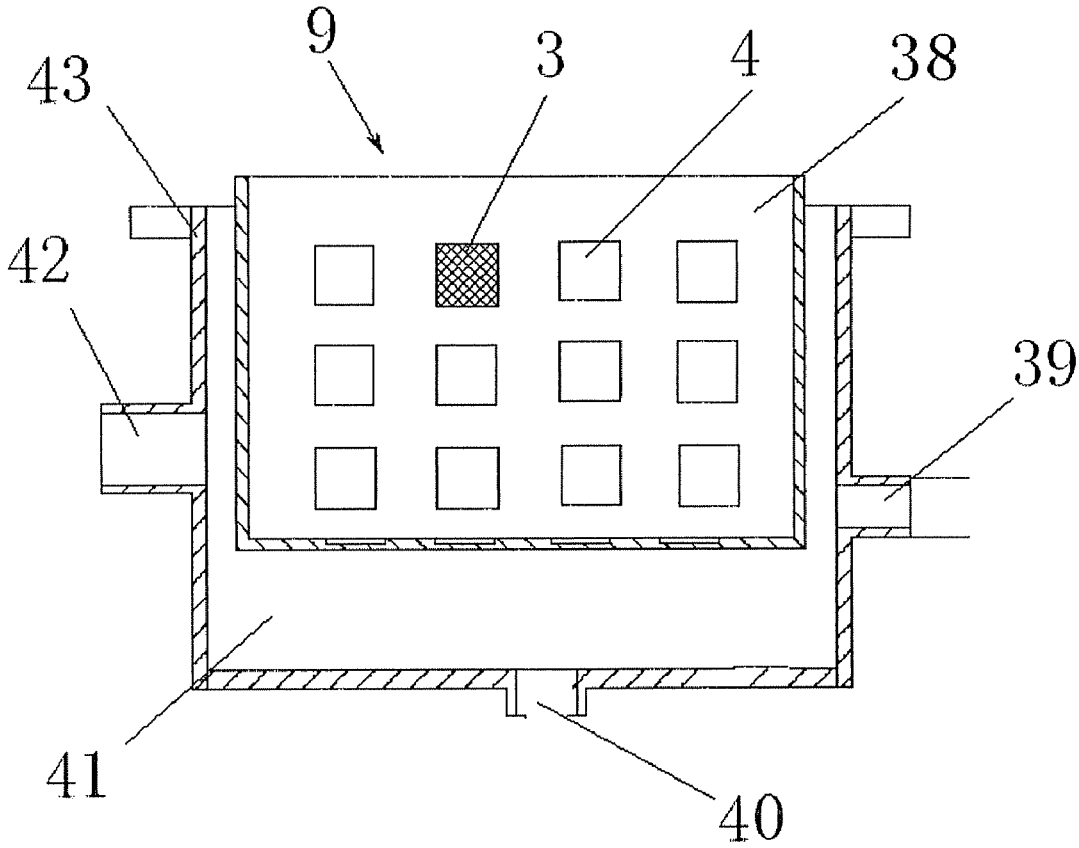
FIG. 3 is the partial detailed schematic view of the improved waterway system close to modifier-liquid supplier.

The process of resin regeneration in softening device 6 is as follow, at the beginning, prepare regenerated-brine with constant concentration, as shown in FIG. 1 and FIG. 3, water via pipe 19 from four-pass water-inlet valve 16 gets into brine-dissolved chamber 41 by water inlet 42, said brine-dissolved chamber 41 is formed by space between the bottom of case 43 and held salt-storage through 38, overflow port 39 is set on the side of case 43 with lower vertical position than water inlet 42 which is set on the other side, redundant water would be drained from overflow port 39 after stopping inflow, meantime, there will be constant water in brine-dissolved chamber 41, water would get touch with salt in predetermined period by the mesh of filter screen 3 set on the side and bottom of salt-storage through 38 to form brine with predetermined concentration, open brine valve 8, brine with predetermined concentration gets into softening device 6 by regenerated-brine outlet 40 and regenerated-brine inlet 27.

As shown in FIG. 4, because of the lower water level, floating ball 44 can't plug regenerated-brine inlet 27, ion-exchange-resin in softening device would be immersed in brine and regenerated, when the amount of brine reaches a certain level, by the gravity of itself, it would press down and open the valve core 34 which is closed by spring 47 in common. Wastewater would be drained from wastewater outlet 46 by pipe 29. To avoid the inverted siphon caused by the broken of pipes, check valve is set on pipe 18, water from four-pass water-inlet valve 16 would go into softening device 6 by check valve, but water from softening device 6 could not get back to top water source causing pollution.

Electromagnetic valve (not shown in Figs) is assembled between electrolyzer 10 and softening-water outlet 26, after the ion-exchange-resin is regenerated, open water inlet to drain wastewater from wastewater outlet 46 by pressure, close the electromagnetic valve to hold back wastewater from the electrolyzer 10.

The improved waterway provided in the present invention is used in the washing machine with upper drainage system, said height of upper outfall 20 is about 80 cm, in the technical scheme of the present invention, we could find:

Check valve is set on the wastewater outlet 46 of softening device 6, and alkaline-electrolysis water outlet 23 and pipe 25 are of pressure, thus when the drainage function of the acid-electrolysis water is of no effect, the acid-electrolysis water would be prevent from getting into the softening device 6 or electrolyzer 10.

In the present invention, acid-electrolysis water could not get back to regenerated-brine device 9 because the bottom of regenerated-brine device 9 is the higher location than upper outfall 20.

Wastewater could not go back the washing machine as the close of drain valve 2.

It would prolong the service life of softening device 6 that the check valve prevents the water drained from washing machine from getting into softening device 6 after opening drain valve in the process of washing, rinsing and dehydration.

Acid wastewater from electrolyzer 10 couldn't reach electrolyzer 10 as the elbow position of siphon 25 set on the acid wastewater outlet is higher than the water level in the inner drum of washing machine.

As the position of overflow port 39 of regenerated-brine device 9 is higher than water level inside the inner drum of washing machine, wastewater could not get into electrolyzer 10.

Drainage vessel 21 set on the pipe between the overflow port 39 and water-outlet system is connecting to the pipe 29 between the wastewater outlet 46 of softening device 6 and water-outlet system.

A better softening-electrolysis system used in the washing machine is provided in the present invention in the above technical scheme, this system would greatly improve the service life of softening device with simple structure and is suitable for large scale industrial production.

The invention claimed is:

1. A washing machine with a waterway system, said washing machine comprising:

an outer drum;

an inner drum;

a water-inlet system;

a water-outlet system; and a driving device along with a controller, wherein, said water-inlet system comprises:

a softening-electrolysis waterway including a softening device, an electrolyzer and a plurality of pipes, a modifier-liquid measured waterway including a metering valve, a modifier-liquid supplier and a plurality of pipes, and an ion-exchange-resin regeneration waterway including a regenerated-brine device and a plurality of pipes;

wherein an inlet of said water-inlet system is mounted with a four-pass water-inlet valve, one end of which is connecting to a tap water inlet, an other end of the valve having four controlled outlets connecting to each end of a first pipe, a second pipe, a third pipe, and a fourth pipe respectively, said first pipe being connected to said modifier-liquid measured waterway, said second pipe being connected to an influent groove, said third pipe being connected to said softening electrolysis waterway, and said fourth pipe being connected to said ion-exchange resin regeneration waterway and said metering valve of said modifier-liquid measured waterway being connected to the modifier-liquid supplier by a fifth pipe, an inlet of the metering valve being connected to the first pipe, two outlets of the metering valve being respectively connected to the influent groove by a sixth pipe and said water-outlet system by a seventh pipe.

2. A washing machine of claim 1, wherein the metering valve comprises an inlet valve for controlling a connection status of said influent groove and said sixth pipe, a modifier-liquid valve for controlling the connection status of said fifth pipe and said modifier-liquid supplier with the metering valve, a drain valve for controlling the connection status of said seventh pipe and said water-outlet system, and an air valve on the top of said modifier-liquid supplier to control air circulation.

3. A washing machine of claim 1, wherein an upper outfall is disposed in the water-outlet system, and the bottom of the regenerated-brine device is no lower than a height of the upper outfall.

4. A washing machine of claim 1, wherein a check valve is disposed on at least one of the third pipe and the first pipe.

5. A washing machine of claim 1, wherein a water-inlet pipe of said softening device being connected to said third pipe, a softened-water outlet of said softening device being connected to said electrolyzer, a wastewater outlet being connected to said water-outlet system by a pipe, an alkaline-electrolysis water outlet of said electrolyzer being connected to said influent groove by a pipe, and an acid-electrolysis water outlet of said electrolyzer being connected to said water-outlet system by a siphon.

6. A washing machine of claim 5, wherein said ion-exchange-resin regeneration waterway comprises a water inlet of said regenerated-brine device connected to said fourth pipe, a regenerated-brine outlet connected to a regenerated-brine inlet of said softening device, and an overflow port connected to said water-outlet system.

7. A washing machine of claim 6, wherein said regenerated-brine device comprises a case, a salt-storage trough located in an upper space of said case and a brine-dissolved chamber formed by a remaining space of the regenerated-brine device, the water inlet and the overflow port being respectively located on two sides of said case, a vertical height of said water inlet being higher than said overflow port, the regenerated-brine outlet being located on the bottom of the case, at least one permeable hole located around the salt-storage trough, and filter screen covers on said permeable hole.

8. A washing machine of claim 6, wherein at least one of an elbow position of a the siphon and a location of an overflow port of the regenerated-brine device are/is higher than the water level inside the inner drum.

9. A washing machine of claim 6, wherein a drainage vessel is disposed on a pipe between the overflow port and the water-outlet system and is connected to a pipe between the wastewater outlet of the softening device and the water-outlet system.

10. A washing machine of claim 5, wherein a resin-storage chamber is set inside the softening device, the resin-storage chamber resin is held by a bracket, said softened-water outlet and a regenerated-brine inlet are set on the top of the softening device, a floating ball to shut down the regenerated-brine inlet is located close to the regenerated brine inlet, a check valve is set at the wastewater outlet on a lower part of the softening device and a water-inlet pipe on the bottom of the softening device or the side close to the bottom.

11. A washing machine of claim 5, wherein an electromagnetic valve is disposed between the electrolyzer and said softened-water outlet.

12. A washing machine with a waterway system, said washing machine comprising:

an outer drum;

an inner drum;

a water-inlet system;

a water-outlet system; and a driving device along with a controller, wherein, said water-inlet system comprises:

a softening-electrolysis waterway including a softening device, an electrolyzer and a plurality of pipes, a modifier-liquid measured waterway including a metering valve, a modifier-liquid supplier and a plurality of pipes, and an ion-exchange-resin regeneration waterway including a regenerated-brine device and a plurality of pipes;

wherein an inlet of said water-inlet system is mounted with a four-pass water-inlet valve, one end of which is connecting to a tap water inlet, an other end of the valve having four controlled outlets connecting to each end of a first pipe, a second pipe, a third pipe, and a fourth pipe respectively, said first pipe being connected to said modifier-liquid measured waterway, said second pipe being connected to an influent groove, said third pipe being connected to said softening electrolysis waterway, and said fourth pipe being connected to said ion-exchange resin regeneration waterway and wherein a water-inlet pipe of said softening device being connected to said third pipe, a softened-water outlet of said softening device being connected to said electrolyzer, a wastewater outlet being connected to said water-outlet system by a pipe, an alkaline-electrolysis water outlet of said electrolyzer being connected to said influent groove by a pipe, and an acid-electrolysis water outlet of said electrolyzer being connected to said water-outlet system by a siphon.

13. A washing machine of claim 12, wherein a resin-storage chamber is set inside the softening device, the resin-storage chamber resin is held by a bracket, said softened-water outlet and a regenerated-brine inlet are set on the top of the softening device, a floating ball to shut down the regenerated-brine inlet is located close to the regenerated brine inlet, a check valve is set at the wastewater outlet on a lower part of the softening device and a water-inlet pipe on the bottom of the softening device or the side close to the bottom.

14. A washing machine of claim 12, wherein an electromagnetic valve is disposed between the electrolyzer and said softened-water outlet.

15. A washing machine of claim 12, wherein an upper outfall is disposed in the water-outlet system, and a bottom of the regenerated-brine device is no lower than a height of the upper outfall.

16. A washing machine of claim 12, wherein at least one of an elbow position of the siphon and a location of an overflow port of the regenerated-brine device are/is higher than the water level inside the inner drum.

17. A washing machine of claim 12, wherein said ion-exchange-resin regeneration waterway comprises, a water inlet of said regenerated-brine device connected to said fourth pipe, a regenerated-brine outlet connected to a regenerated-brine inlet of said softening device, and an overflow port connected to said water-outlet system.

18. A washing machine of claim 17, wherein a drainage vessel is disposed on a pipe between the overflow port and the water-outlet and system is connected to a pipe between the wastewater outlet of the softening device and the water-outlet system.

19. A washing machine of claim 12, wherein said regenerated-brine device comprises a case, a salt-storage trough located in an upper space of said case and a brine-dissolved chamber formed by a remaining space of the regenerated-brine device, a water inlet and overflow port being respectively located on two sides of said case, a vertical height of said water inlet being higher than said overflow port, a regenerated-brine outlet located on the bottom of the case, at least one permeable hole located around the salt-storage trough, and filter screen covers on said permeable hole.

20. A washing machine of claim 12, wherein a check valve is disposed on at least one of the third pipe and the first pipe.

* * * * *